United States Patent [19]

Kistrup

[11] Patent Number: 5,076,199

[45] Date of Patent: Dec. 31, 1991

[54] APPARATUS FOR THE CHEMICAL METALLIZATION OF OPEN-PORED FOAMS, NONWOVENS, NEEDLE FELTS OF PLASTIC OR TEXTILE MATERIAL

[75] Inventor: Holger Kistrup, Esslingen, Fed. Rep. of Germany

[73] Assignee: Deutsche Automobilgesellschaft MbH, Fed. Rep. of Germany

[21] Appl. No.: 517,849

[22] Filed: May 2, 1990

[30] Foreign Application Priority Data

May 4, 1989 [DE] Fed. Rep. of Germany ..... 3914726

[51] Int. Cl.[5] ..... B05C 21/00

[52] U.S. Cl. ..... 118/52; 118/400; 118/500; 118/DIG. 7; 118/421

[58] Field of Search ..... 118/52, 72, 400, 423, 118/500, DIG. 7, 421; 427/443.1

[56] References Cited

U.S. PATENT DOCUMENTS 1,734,737 11/1929 Martindell ..... 118/52

4,645,573 2/1987 Orban ..... 204/21

4,681,777 7/1987 Engelken et al. ..... 427/443.1

FOREIGN PATENT DOCUMENTS 1169720 6/1984 Canada ..... 427/443.1

1696090 11/1971 Fed. Rep. of Germany .

2844708 4/1980 Fed. Rep. of Germany . .

*Primary Examiner*—Michael Wityshyn

*Assistant Examiner*—Brenda Lamb

*Attorney, Agent, or Firm*—Evenson, Wands, Edwards, Lenahan & McKeown

[57] ABSTRACT

An apparatus for the chemical metallization of open-pored foams, nonwovens, needle felts of plastic material or similar textile material, in particular those having a porosity of 45 to 98%, has three processing stations. The first processing station is a laying station, the second is a chemical metallization station and the third is a centrifugal station. The material of the substrate webs treated in the apparatus is made of polypropylene, polyethylene, polyamide, polyester or aminoplasts.

4 Claims, 1 Drawing Sheet

APPARATUS FOR THE CHEMICAL METALLIZATION OF OPEN-PORED FOAMS, NONWOVENS, NEEDLE FELTS OF PLASTIC OR TEXTILE MATERIAL

BACKGROUND AND SUMMARY OF THE INVENTION

The present invention relates to an apparatus for the chemical metallization of previously activated porous substrate webs of foams, nonwovens, needle felts, of plastic material having a porosity of 45 to 98% of the substrate material.

The chemical metallization of plastic surfaces in particular is constantly becoming more widespread. It may be that, in automobile construction, certain plastic parts are to be given a decorative exterior by the application of a metal layer. Often, in the fabrication of household articles, tools, machines for work and for everyday use, a plastic part is to be protected on its surface by a metal layer or metallized for some other reason. This means that, with a very large number of consumer goods of every type and function, currently it appears to be economically attractive to combine the advantages of plastic bodies with respect to weight, shaping, damping, physical properties, price etc. with metallic properties, such as, for example, gleam, magnetism, electric conductivity, thermal conductivity or shielding effect, by the application of a metallic layer to the plastic surface.

However, such plastic surfaces cannot just be coated with a metal layer. Rather, it is common practice that, following a suitable pretreatment matched to the specific function of the component or workpiece to be metallized, the plastic surface is activated. The pretreatment may involve, for example, cleaning, roughening, etching, coating or the like, whereas the stated activation of the plastic surface is to be understood as its coating with a catalytically active substance. During the course of the activation, catalytically active particles based on Pd/Sn come to be deposited particularly frequently. Other activation methods, free from precious metals, are known but are clearly in the minority in terms of the quantity processed.

Once activation of the surfaces of the textile substrate has taken place, the chemical metallization of the activated substrate surface is subsequently carried out. For this purpose, the substrate is usually immersed in a metallization bath, such baths being based on copper, silver and nickel, with nickel being preferred.

The preparation and the composition of such activation solutions are known, for example from German Auslegesschrift 1,197,720 or German Offenlegungsschrift 2,743,768. A great variety of metallization solutions are likewise known to persons skilled in the art. Along with complexing agents and agents for adjusting the pH, normally the metallization solutions principally contain a dissolved salt of the metal to be deposited as well as a reducing agent. Usually sodium hypophosphite or sodium borohydride, also alkylaminoboranes or formalin, are used as a reducing agent.

Following the pretreatment, activation and chemical metallization steps, then (if desired) the metal layer present on the plastic surface is further reinforced by galvanic means. This is done either with the same metal as in the metallization or another metal or a metal alloy, until finally the plastic part has on its surface the desired metallic properties.

It is also known to make porous plastic substrates surface-conductive by graphitizing or vapor-depositing metals and subsequently subjecting them to a multistage treatment in electroplating baths (German Offenlegungsschrift 1,696,090). It is also known from this specification to remove the particles of liquid remaining in the pores of the substrate web by means of a suction-removal apparatus after electroplating. Also, according to German Offenlegungsschrift 2,844,708, a non-conducting porous strip can be made electrically conductive in order to electroplate it subsequently in a multistage process. The methods specified in these two specifications require very complex apparatus and a great expenditure of time.

Copper and nickel are the favored metals in chemical metal deposition on plastic surfaces in the industrial sector. Some references which discuss pretreatment, activation and chemical metallization are, for example, "Kunststoff-Galvanisierung" (Plastic Electroplating), E. Leuze Verlag, (Saulgau) and General Methods of Galvanic Metal Deposition from the "Handbuch der Galvanotechnik" (Electrodeposition Manual), volume 1–4, published by H. W. Dettner/J. Elze, Carl Hanser Verlag Munich 1964.

Today, the technique of chemical metal deposition on plastic surfaces does not generally present a problem. However, a manufacturer desires to produce the required metallic properties on the plastic surface, such as gleam, hardness, adhesive strength, economically viably with chemicals which are, as far as possible, environmentally compatible and harmless from the aspect of industrial medicine.

Problems occur in chemical metallization only when plastic materials which are highly porous and consequently have a relatively great surface area, such as open-pored foams, needle felts, nonwovens or other textile materials are to be chemically metallized after their activation. The enormously large surface of these plastic bodies in their highly porous configuration of 45–98% porosity, with up to several square meters of surface per g of processed plastic, means that, in chemical metallization, large quantities of gas are liberated in a short time by the accompanying evolution of hydrogen. With the reliable removal by suction of large quantities of hydrogen already being a task in itself, it is additionally hampered by the further heating of the metallization solution, observed in chemical metallization. This causes vapors to form over the solution, which are in themselves already harmful to health and are further increased in their harmful potential by entrained minute particles of metal. The consequence of this is that the entire metallization system has to be equipped with a complex and expensive suction-removal system, which of course burdens the cost-effectiveness of the chemical metallization process. The chemical metallization of such highly porous plastic webs is discussed in German Patent Specification 3,710,895.

An object of the present invention is to provide a space-saving apparatus for the chemical metallization of previously activated open-pored substrate webs of foams, nonwovens, needle felts of plastic or textile material, in particular having a porosity of 45 to 98% of the substrate material, in order to subject these substrates to a chemical metallization in a technically easily manageable manner. This should be done economically yet with good technical properties with respect to subsequent processing of the material bringing the substrate webs into contact with the chemical metallization solution; chemical metallization of the substrate web; and centrifugal throwing off of used and/or excess chemical metallization solution once chemical metallization of the substrate web has taken place.

Another object of the present invention is to optimize the working cycle of the three individual working steps listed above. These steps all require working times of different lengths. The optimization should allow a continuous production of metallized nonwoven or needle-felt webs or open-pored foams with minimal labor expenditures.

SUMMARY OF THE INVENTION

This and other objects are met by the present invention which provides an apparatus for the chemical metallization of previously-activated porous substrate webs of foams, nonwovens, needle-felts, of plastic material or of textile material. The webs have a porosity of 45 to 98% of the substrate material. The apparatus comprises a laying station, a chemical metallization station and a centrifugal station. The laying station has a movable device and at least one container with chemical metallization solution on the movable device. The substrate web to be metallized is brought into contact with the chemical metallization solution by uniform laying in the container. The chemical metallization station is coupled to the laying station. At least one container with the chemical metallization solution is introduced into the chemical metallization station immediately after laying the substrate web in the container in the laying station and before initiation of a chemical metallization reaction. The chemical metallization station has a suction removal apparatus for removing the gases and vapors produced during the chemical metallization reaction. The centrifugal station is coupled to the chemical metallization solution. In this centrifugal station, the chemically metallized substrate web is removed from the at least one container with the chemical metallization solution. The chemical metallization station a centrifugal drum. The chemically metallized substrate web is wound on the centrifugal drum, with still present excess chemical metallization solution being thrown off out of the pores of the chemically metallized substrate web.

One of the advantages of the invention is, in particular, that substrate webs of open-pored foams, nonwovens, needle felts of plastic or textile material can be chemically metallized quickly and uncomplicatedly in a technically easily manageable apparatus which required a low expenditure on apparatus, with economically favorable boundary conditions. At the same time, the metallized substrates have good technical properties, in particular with a view to their intended further treatment.

Another advantage is that by the simultaneous introduction of a plurality of metallization containers into the metallization station, the time-determining step of chemical metallization can be adapted advantageously to the working sequence of laying and centrifuging in such a way that a single laying and centrifuging station can be used for continuous fabrication, without delays having to occur in the working cycle due to the time-consuming metallization time. This is possible due to the capacity of the metallized felt webs to be kept in the reducing medium in the metallization station.

Other objects, advantages and novel features of the present invention will become apparent from the following detailed description of the invention when considered in conjunction with the accompanying drawings.

DETAILED DESCRIPTION OF THE DRAWINGS

Figure 1:
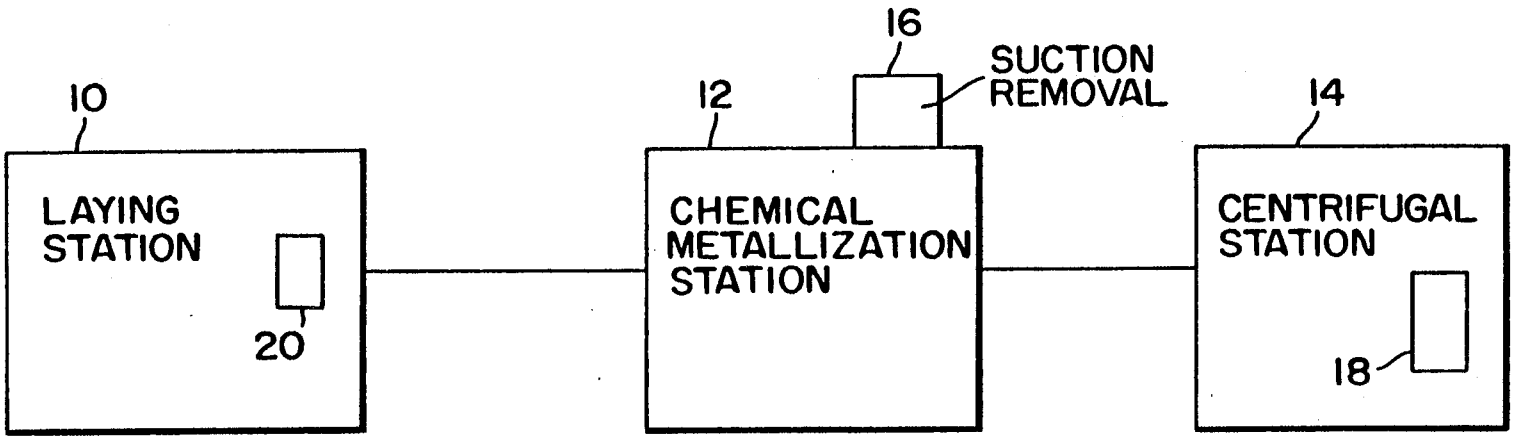
FIG. 1 shows an apparatus for the chemical metallization of previously activated porous substrate webs constructed in accordance with an embodiment of the present invention.

The apparatus shown in FIG. 1 has three processing stations 10, 12, 14 for the processing activated porous substrate webs. The first processing station is a laying station 10, in which there is a container with chemical metallization solution on a movable device. Into this solution the previously activated porous substrate web is laid once a pretreatment, such as cleaning, drying or the like has taken place. The web is then brought into contact with the chemical metallization solution.

The second processing station is a chemical metallization station 12, in which the substrate web is chemically metallized. This chemical metallization station 12 is equipped with a suction-removal apparatus 16, for removal of the gases produced during chemical metallization, in particular hydrogen and vapors.

The third processing station is a centrifugal station 14, in which the completely metallized substrate web is freed by mechanical means 18 (such as a centrifugal wheel) of the used metallization solution that may still be present on the surface or in the pores of the web. Any necessary rinsing and centrifuging operations, performed in order to remove excess metallization solution, can be carried out in this centrifugal station 14.

In an embodiment of the invention, the metallization station 12 accommodates a plurality of metallization containers simultaneously. This allows the treatment operation that is most harmful to health to be accomplished in a manner saving as much space as possible. Since the chemical metallization solutions often contain reducing agents in excess, in principle the leaving of metallized substrate webs for a long time beyond the actual metallization time is harmless.

The metallization station 12 is equipped with suction-removal apparatus 14 for hydrogen, metal solution vapors and minute particles of metal. This apparatus 14 must meet the strictest safety standards. The situation is rather different for the upstream laying station 10 and the downstream centrifugal station 14. In these stations, little or no hydrogen is evolved, meaning that the usual inexpensive suction-removal apparatuses will suffice for the protection of operating personnel in the majority of cases.

The centrifugal station 14 serves to remove used metallization solution from the pores of the plastic web and to reduce to an acceptable level any remains of used metallization solution still present after the first centrifuging operation by renewed rinsing and centrifuging operations. In the centrifuging operations, the speed of the device must be adapted to the porosity and the mechanical resistance of the substrate web. Generally, this does not represent any particular difficulty for a person skilled in the art.

The operation of the apparatus according to the present invention is explained in still further detail below using an example.

A needle-felt web of polypropylene having a porosity of 91% (fibre thickness 2.7 dtex), a nominal thickness of 2.5 mm, a width of 50 cm and a length of 19 m, was activated with an activation solution prepared on the basis of Pd/Sn in a known manner, such as described in German Patent Specification 3,631,055. The activated felt web was folded together lengthwise into several layers one on top of the other, so that the reduced web length was only 1.6 m (instead of 19 m). Consequently, about 12 layers of the felt lay one on top of the other and the total thickness of the web with reduced length was about $12 \times 2.5$ mm $= 30$ mm. This web, folded flush together, was laid in a metallization container, which comprised a tank having the dimensions 1.6 m$\times$0.5 m$\times$0.2 m, which was firmly mounted on a movable carriage. In this arrangement, the tank was located underneath an extraction hood open on one side and was filled with a 20° C. warm chemical nickelizing solution (25 l from 1200 g of $NiCl_2 \cdot 6H_2O$, 1800 g of $NaH_2 \cdot PO_2 \cdot H_2O$, 3000 g of $NH_4Cl$, 1400 g of NaOH, the remainder water).

Immediately after the uniform laying of the web into the nickelizing solution in the laying station 10, the web was prevented from floating by appropriately fixed nets and, before vigorous evolution of hydrogen commenced, pushed with the carriage into the metallization station 12 which could be closed on all sides and only had a suction-removal opening at the top for the escaping hydrogen. After about 30 minutes, the metallization was complete, after which the used solution was drained away through the floor of the metallization tank. After that, the metallization container was moved to the centrifugal station 14 and, once the floating nets in the metallization container had been removed, the filter web was taken out and wound onto a centrifugal reel; the metallization container was returned to the laying station 10.

On the centrifugal reel, once a sleeve had been placed around the felt web and the collecting container closed, the web was centrifuged at about 600 revolutions/minute. Thereafter, the felt web was rinsed once again with water and centrifuged once more. The felt web was then chemically nickelized uniformly over the surface of its fibres.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. Apparatus for the chemical metallization of previously activated porous substrate webs of foams, nonwovens, needle felts, plastic material or textile material, the webs having a porosity of 45 to 98% of the substrate material, comprising:

a) a container for containing a chemical metallization solution and a substrate web;

b) a movable device capable of carrying said container;

c) a laying station in which a substrate web to be metallized is brought into contact with a chemical metallization solution by uniform laying in the container, the container being arranged on the movable device;

d) a chemical metallization station into which the movable device carrying the container with the chemical metallization solution is introduced immediately after laying the substrate web in the container in the laying station and before initiation of a chemical metallization reaction, said chemical metallization station having a suction-removal apparatus for removal of gases and vapors produced during the chemical metallization reaction;

e) a centrifugal station into which the movable device is moved and in which the chemically metallized substrate web is removed from the container with the chemical metallization solution immediately after being moved into the centrifugal station, said centrifugal station having means for centrifuging the chemically metallized substrate web that includes a centrifugal reel onto which said chemically metallized substrate web is wound, said centrifugal reel being rotatable such that still present excess chemical metallization solution is thrown off out of the pores of the chemically metallized substrate web upon rotation of the centrifugal reel.

2. Apparatus according to claim 1, wherein the chemical metallization station is structured to hold a plurality of containers with a chemical metallization solution and substrate webs that have been laid in the chemical metallization solution and which are to be metallized, the plurality of containers being arranged next to one another in the chemical metallization.

3. Apparatus according to claim 1, wherein the chemical metallization station is structured to hold a plurality of containers with a chemical metallization solution and substrate webs that have been laid in the chemical metallization solution and which are to be metallized, the plurality of containers being arranged above one another in the chemical metallization station.

4. Apparatus according to claim 1, wherein the substrate webs are made of polypropylene, polyethylene, polyamide, polyester or aminoplasts.

* * * * *